US010519785B2

(12) United States Patent
Zemitis et al.

(10) Patent No.: US 10,519,785 B2
(45) Date of Patent: Dec. 31, 2019

(54) TURBINE BLADES HAVING DAMPER PIN SLOT FEATURES AND METHODS OF FABRICATING THE SAME

(71) Applicant: General Electric Company, Schenectady, NY (US)

(72) Inventors: William Scott Zemitis, Simpsonville, SC (US); Melbourne James Myers, Woodruff, SC (US); Richard Ryan Pilson, Greer, SC (US); Calvin Levy Sims, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 354 days.

(21) Appl. No.: 15/431,950

(22) Filed: Feb. 14, 2017

(65) Prior Publication Data

US 2018/0230820 A1 Aug. 16, 2018

(51) Int. Cl.

| | |
|---|---|
| ***F01D 5/24*** | (2006.01) |
| ***F01D 5/16*** | (2006.01) |
| ***F01D 5/26*** | (2006.01) |
| ***F01D 5/14*** | (2006.01) |
| ***F01D 5/30*** | (2006.01) |
| ***F01D 25/06*** | (2006.01) |
| ***B21D 53/78*** | (2006.01) |
| ***F01D 5/22*** | (2006.01) |

(52) U.S. Cl.

CPC ..... *F01D 5/24* (2013.01); *B21D 53/78* (2013.01); *F01D 5/143* (2013.01); *F01D 5/16* (2013.01); *F01D 5/22* (2013.01); *F01D 5/26* (2013.01); *F01D 5/3015* (2013.01); *F01D 25/06* (2013.01); *F05D 2240/80* (2013.01); *F05D 2260/96* (2013.01)

(58) Field of Classification Search

CPC ..... F01D 5/25; F01D 25/06
USPC ..... 416/190
See application file for complete search history.

(56) References Cited

U.S. PATENT DOCUMENTS

| | | | | |
|---|---|---|---|---|
| 5,302,085 | A * | 4/1994 | Dietz | F01D 5/22 416/193 A |
| 6,171,058 | B1 | 1/2001 | Stec | |
| 6,582,194 | B1 * | 6/2003 | Birkner | B23P 15/04 415/115 |
| 6,776,583 | B1 | 8/2004 | Wang et al. | |
| 8,790,086 | B2 | 7/2014 | Honkomp et al. | |
| 2005/0095134 | A1 * | 5/2005 | Zhang | F01D 5/147 416/193 A |
| 2011/0311358 | A1 * | 12/2011 | Xiao | F01D 5/3007 416/1 |
| 2012/0237348 | A1 * | 9/2012 | Thomen | F01D 5/22 416/196 R |

(Continued)

*Primary Examiner* — Philip E Stimpert
*Assistant Examiner* — Timothy P Solak
(74) *Attorney, Agent, or Firm* — Armstrong Teasdale LLP

(57) ABSTRACT

A turbine blade includes an airfoil that extends radially between a root end and a tip end, a platform coupled to the root end, and a shank that extends radially inwardly from the platform. The shank includes a cover plate. The cover plate includes an outer surface, an opposite inner surface, and a contoured face that at least partially defines a damper pin slot. The contoured face extends from the outer surface to a first blend edge. The cover plate also includes a blended surface that extends from the first blend edge to a second blend edge. The second blend edge intersects with the inner surface.

18 Claims, 6 Drawing Sheets

(56) References Cited

U.S. PATENT DOCUMENTS

| | | | | |
|---|---|---|---|---|
| 2013/0136618 | A1* | 5/2013 | Stapleton | F01D 5/143<br>416/235 |
| 2014/0150454 | A1* | 6/2014 | Faulder | F01D 5/141<br>60/805 |

* cited by examiner

TURBINE BLADES HAVING DAMPER PIN SLOT FEATURES AND METHODS OF FABRICATING THE SAME

BACKGROUND

The field of the disclosure relates generally to rotary machines, and more particularly, to a turbine blade with damper pin slot features that facilitate reduced stress peaks and gradients within a shank of the blade.

At least some known rotary machines include a compressor, a combustor coupled downstream from the compressor, a turbine coupled downstream from the combustor, and a rotor shaft rotatably coupled between the compressor and the turbine. Some known turbines include at least one rotor disk coupled to the rotor shaft, and a plurality of circumferentially-spaced turbine blades that extend outward from each rotor disk to define a stage of the turbine. Each turbine blade includes an airfoil that extends radially outward from a platform towards a turbine casing.

At least some known turbine blades include a shank and dovetail radially inward of the platform to facilitate coupling the blade to the rotor disk. In addition, at least some known shanks include a damper pin slot configured to receive a damper pin. An operational life cycle of at least some turbine blades is limited at least in part by wear resulting from transient interactions between the damper pin slot and the damper pin. However, modifications to the damper pin slot are difficult to implement, due to a need both to accommodate damper pin loads and to transfer pull loads from airfoil to the shank.

BRIEF DESCRIPTION

In one aspect, a turbine blade is provided. The turbine blade includes an airfoil that extends radially between a root end and a tip end, a platform coupled to the root end, and a shank that extends radially inwardly from the platform. The shank includes a cover plate. The cover plate includes an outer surface, an opposite inner surface, and a contoured face that at least partially defines a damper pin slot. The contoured face extends from the outer surface to a first blend edge. The cover plate also includes a blended surface that extends from the first blend edge to a second blend edge. The second blend edge intersects with the inner surface.

In another aspect, a method of forming a damper pin slot for a turbine blade is provided. The turbine blade includes a shank that includes a cover plate. The method includes providing the cover plate having an outer surface, an opposite inner surface, and a contoured face extending from the outer surface to the inner surface. The contoured face intersects the inner surface along each of a first edge and a second edge. The second edge extends as a continuation of the first edge. The method also includes modifying the second edge such that a blended surface is formed between the contoured face and the inner surface. The contoured face having the modified second edge at least partially defines the damper pin slot

DETAILED DESCRIPTION

The embodiments described herein include a turbine blade shank in which a damper pin slot includes a blended surface that facilitates reducing transient interference with a damper pin, while maintaining stress concentrations in the shank below a threshold level. In some embodiments, the damper pin slot of an existing turbine blade is modified by forming the blended surface on a previously formed inner edge of the damper pin slot. In at least some embodiments, the blended surface provides these advantages without requiring any corresponding modification of a shape of the damper pin to be used in the slot.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Accordingly, a value modified by a term or terms such as "about," "approximately," and "substantially" is not to be limited to the precise value specified. In at least some instances, the approximating language may correspond to the precision of an instrument for measuring the value. Here and throughout the specification and claims, range limitations may be identified. Such ranges may be combined and/or interchanged, and include all the sub-ranges contained therein unless context or language indicates otherwise. Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item. As used herein, the term "upstream" refers to a forward or inlet end of a gas turbine engine, and the term "downstream" refers to a downstream or nozzle end of the gas turbine engine.

Figure 1:
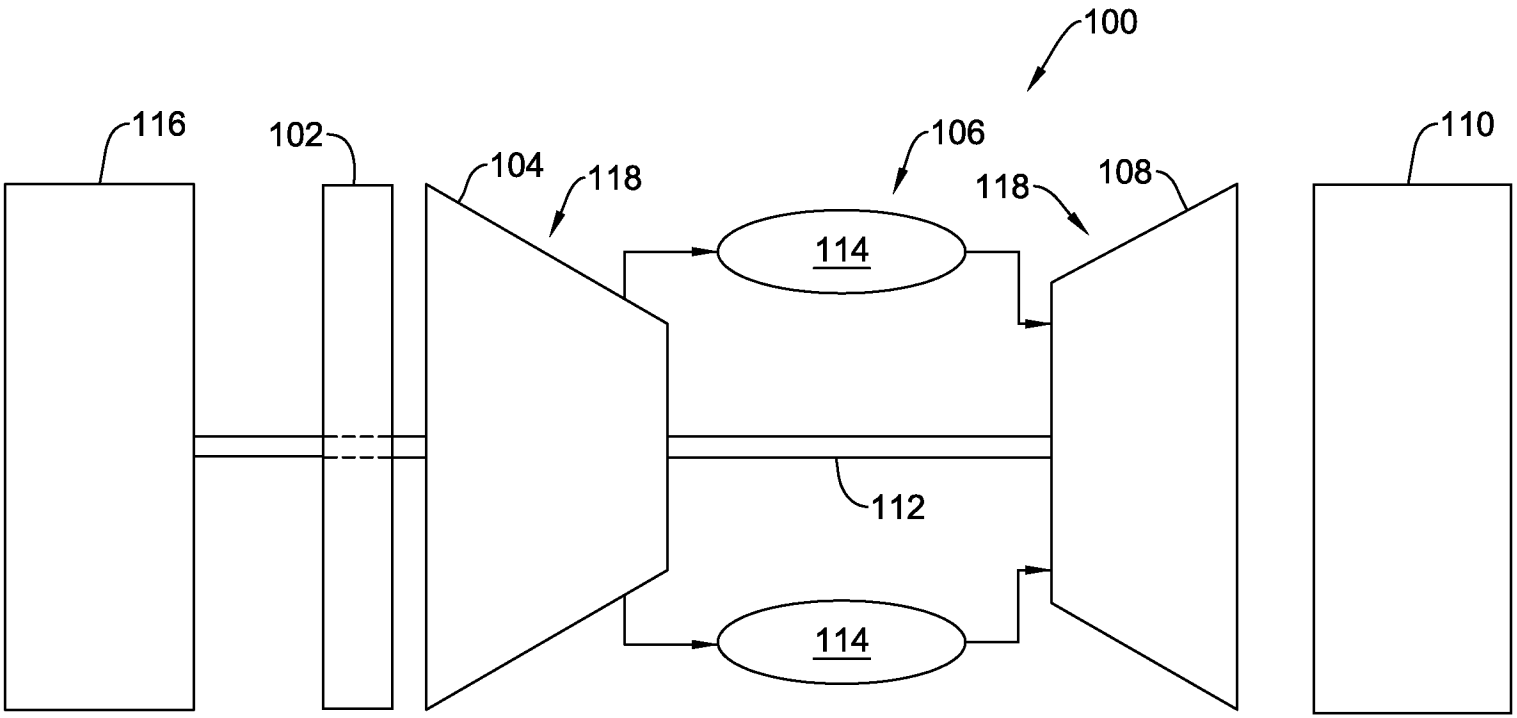
FIG. 1 is a schematic view of an exemplary rotary machine.

FIG. 1 is a schematic view of an exemplary rotary machine 100. In the exemplary embodiment, rotary machine 100 is a gas turbine engine. Alternatively, rotary machine 100 is any other turbine engine and/or rotary machine, including, without limitation, a steam turbine engine, a gas turbofan aircraft engine, other aircraft engine, a wind turbine, a compressor, and/or a pump. In the exemplary embodiment, gas turbine 100 includes an intake section 102, a compressor section 104 that is coupled downstream from intake section 102, a combustor section 106 that is coupled downstream from compressor section 104, a turbine section 108 that is coupled downstream from combustor section 106, and an exhaust section 110 that is coupled downstream from turbine section 108. Turbine section 108 is coupled to compressor section 104 via a rotor shaft 112. In the exemplary embodiment, combustor section 106 includes a plurality of combustors 114. Combustor section 106 is coupled to compressor section 104 such that each combustor 114 is in flow communication with the compressor section 104. Turbine section 108 is further coupled to a load 116 such as, but not limited to, an electrical generator and/or a mechanical drive application. In the exemplary embodiment, each compressor section 104 and turbine section 108 includes at least one rotor assembly 118 that is coupled to rotor shaft 112.

Figure 2:
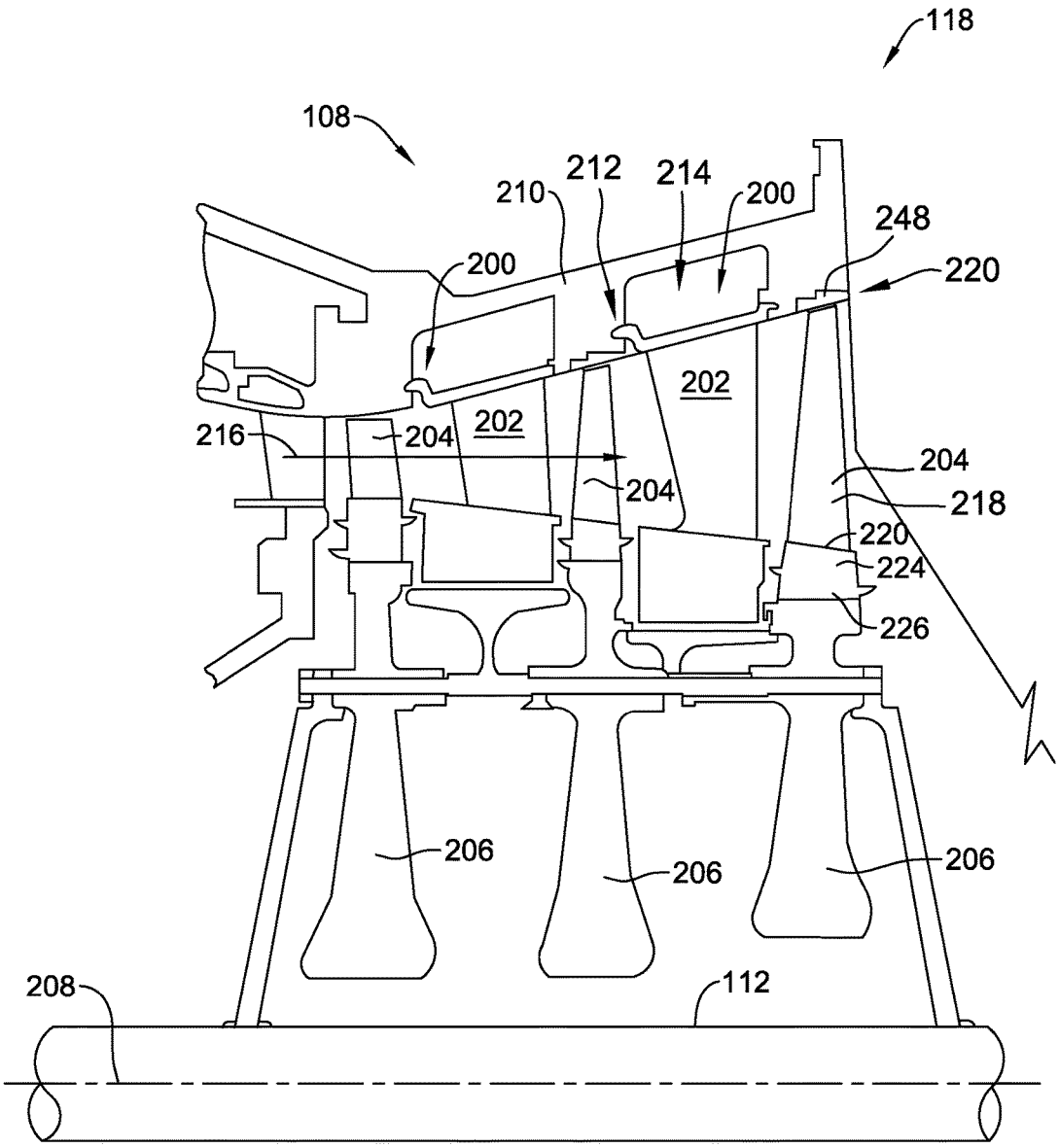
FIG. 2 is a partial sectional view of a portion of an exemplary rotor assembly that may be used with the rotary machine shown in FIG. 1.

FIG. 2 is a partial sectional view of a portion of an exemplary rotor assembly 118. In the exemplary embodiment, turbine section 108 includes a plurality of stages 200 that each include a stationary row 212 of stator vanes 202 and a row 214 of rotating turbine blades 204. Turbine blades 204 in each row 214 are spaced circumferentially about, and extend radially outward from, a rotor disk 206. Each rotor disk 206 is coupled to rotor shaft 112 and rotates about a centerline axis 208 that is defined by rotor shaft 112. A turbine casing 210 extends circumferentially about rotor assembly 118 and stator vanes 202. Stator vanes 202 are each coupled to turbine casing 210 and each extends radially inward from casing 210 towards rotor shaft 112. A combustion gas path 216 is defined between turbine casing 210 and each rotor disk 206. Each row 212 and 214 of turbine blades 204 and stator vanes 202 extends at least partially through a portion of combustion gas path 216.

With reference to FIGS. 1 and 2, during operation, intake section 102 channels air towards compressor section 104. Compressor section 104 compresses air and discharges compressed air into combustor section 106 and towards turbine section 108. The majority of air discharged from compressor section 104 is channeled towards combustor section 106. More specifically, pressurized compressed air is channeled to combustors 114 wherein the air is mixed with fuel and ignited to generate high temperature combustion gases. The combustion gases are channeled towards combustion gas path 216, wherein the gases impinge upon turbine blades 204 and stator vanes 202 to facilitate imparting a rotational force on rotor assembly 118.

Figure 3:
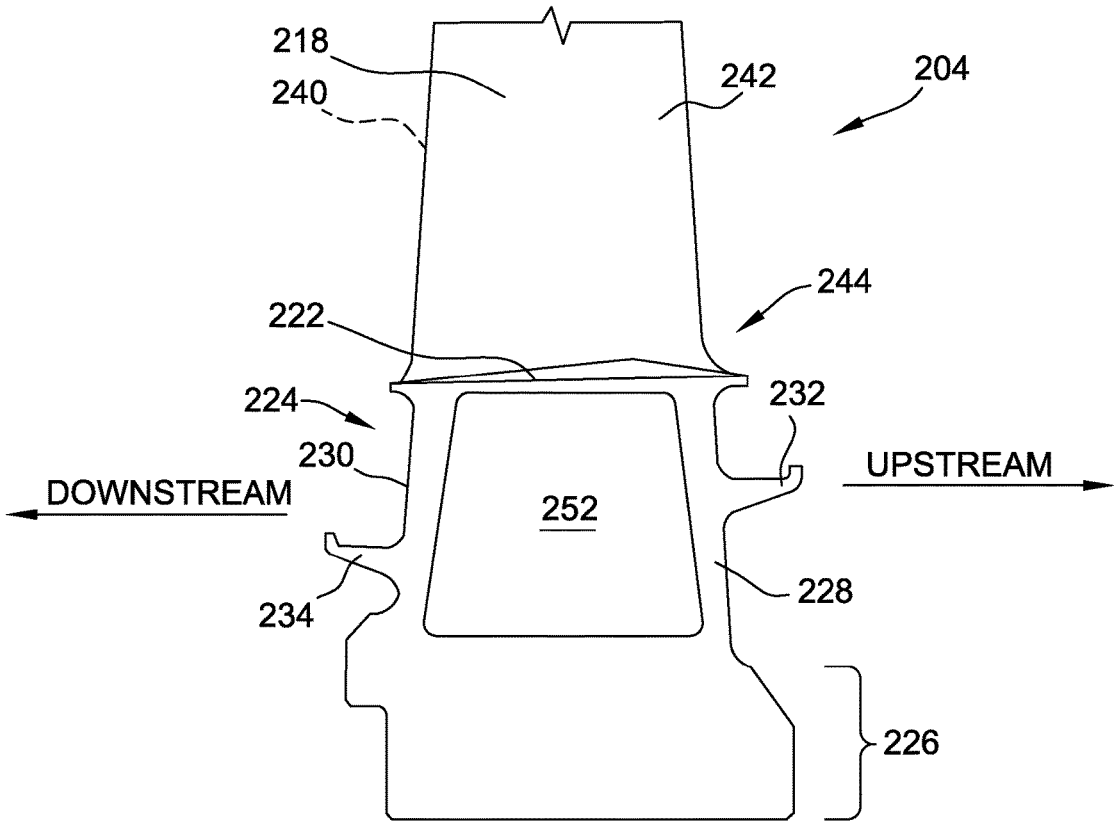
FIG. 3 is a perspective view of a pressure side of an exemplary turbine blade that may be used with the rotor assembly shown in FIG. 2.
Figure 4:
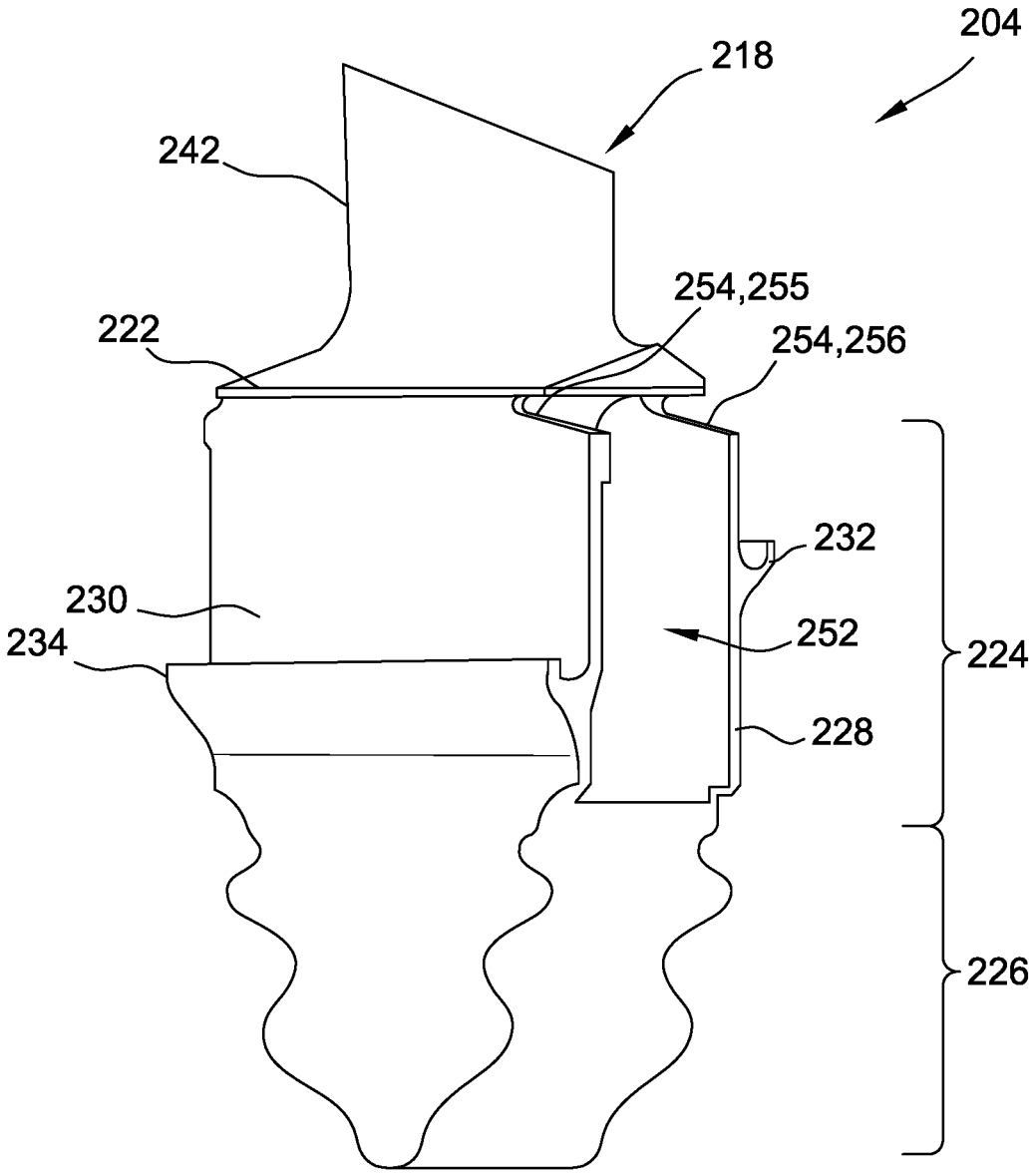
FIG. 4 is a perspective view of an exemplary shank, dovetail, and platform that may be used with the turbine blade shown in FIG. 3.

FIG. 3 is a perspective view of a pressure side of an exemplary turbine blade 204. FIG. 4 is a perspective view of an exemplary shank 224, a dovetail region 226, and a platform 222 for use with exemplary blade 204. With reference to FIGS. 2-4, in the exemplary embodiment, each turbine blade 204 includes an airfoil 218 that extends radially between a root end 244 and a tip end 220 and that defines a pressure side 240 and an opposite suction side 242. Further in the exemplary embodiment, each turbine blade 204 includes a tip shroud 248 extending from tip end 220 of airfoil 218, a platform 222 coupled to root end 244, a shank 224 that extends radially inwardly from platform 222, and dovetail region 226 that extends radially inwardly from shank 224 and that is shaped to facilitate secure coupling of blade 204 to rotor disk 206. More specifically, in the exemplary embodiment, dovetail 226 is characterized by a wavy outer surface that is shaped to be received within a complementarily shaped slot (not shown) defined in rotor disk 206. In alternative embodiments, dovetail 226 has any other suitable shape that enables blade 204 to function as described herein. Platform 222 at least partially defines a radially inner boundary of hot gas path 216. In alternative embodiments, each blade 204 includes any suitable structure that enables blade 204 to function as described herein.

In the exemplary embodiment, shank 224 includes an upstream cover plate 228 and a downstream cover plate 230. Upstream cover plate 228 and downstream cover plate 230 each extend radially between dovetail 226 and platform 222, and laterally from a pressure side face 250 to an opposite suction side face 252 of shank 224. An upstream angel wing 232 extends axially upstream, relative to hot gas path 216, from upstream cover plate 228, and extends laterally along a face of upstream cover plate 228. A downstream angel wing 234 extends axially downstream from downstream cover plate 230, and extends laterally along a face of downstream cover plate 230. In alternative embodiments, blade 204 includes any suitable number of each of upstream angel wings 232 and downstream angel wings 234, including zero, that enables blade 204 to function as described herein.

A damper pin slot 254 is at least partially defined by each of upstream cover plate 228 and downstream cover plate 230, adjacent to and radially inward from platform 222. Damper pin slot 254 is configured to receive a suitable damper pin (not shown) such that an effect of vibratory stimuli on blade 204 during operation of rotor assembly 118 (shown in FIG. 2) is reduced. In the exemplary embodiment, damper pin slot 254 is adjacent to suction side face 252. In alternative embodiments, damper pin slot 254 is adjacent to pressure side face 250. A portion of damper pin slot 254 defined by downstream cover plate 230 is designated as downstream portion 255 of damper pin slot 254, and a portion of damper pin slot 254 defined by upstream cover plate 228 is designated as upstream portion 256 of damper pin slot 254.

Figure 5:
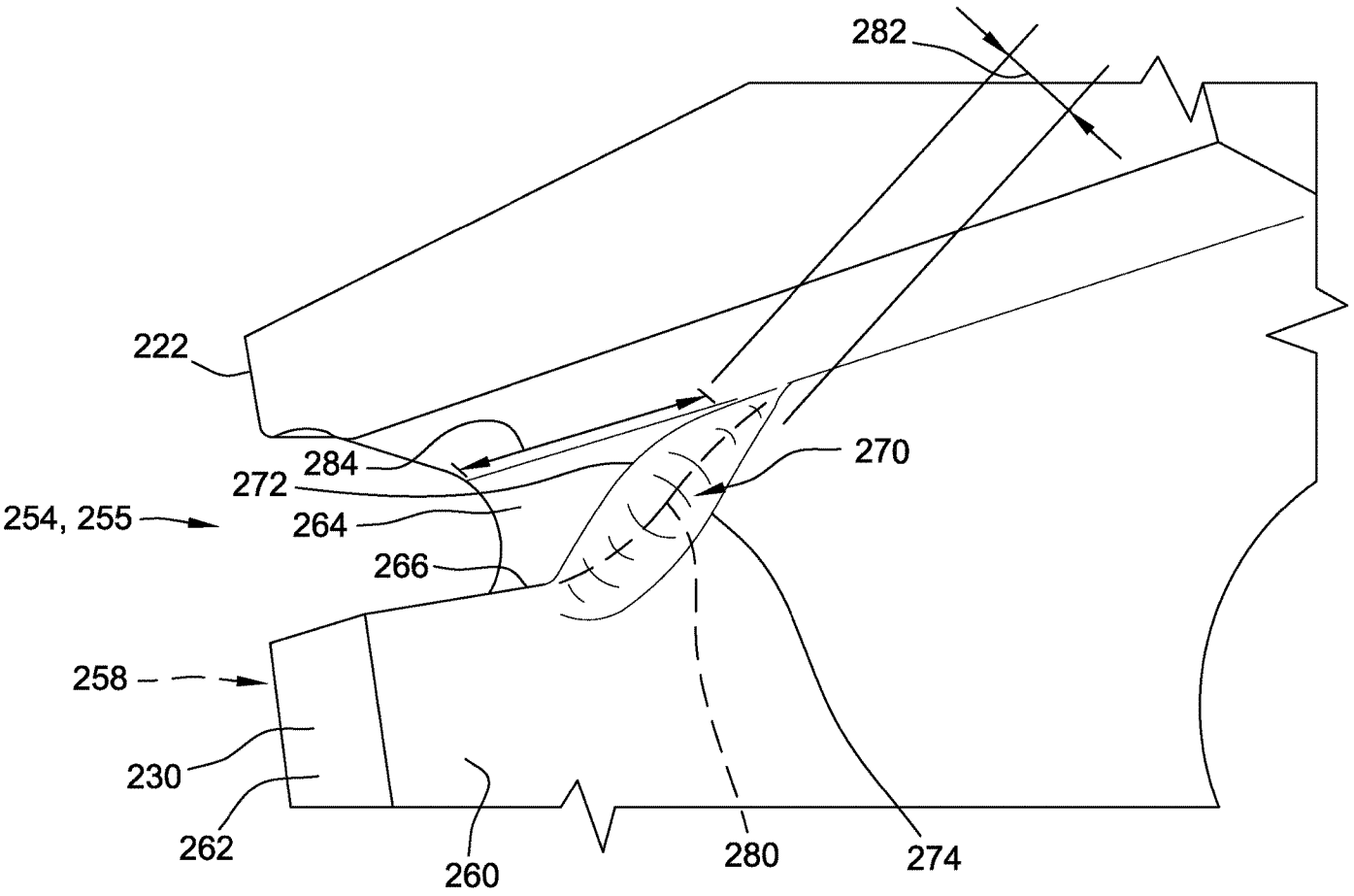
FIG. 5 is a perspective view of a portion of a damper pin slot that may be used with the turbine blade shown in FIG. 3.

FIG. 5 is a perspective view of downstream portion 255 of damper pin slot 254. Suction side face 252 of shank 224 is not shown in FIG. 5 for clarity of explanation. In the exemplary embodiment, downstream cover plate 230 includes an outer or downstream surface 258 and an opposite inner or upstream surface 260. Downstream cover plate 230 also includes a side face 262 extending radially inward of damper pin slot 254, and extending axially between outer surface 258 and inner surface 260. Damper pin slot 254 is at least partially defined on downstream cover plate 230 by a contoured face 264 that slopes radially outward from side face 262 to platform 222. A first edge 266 is defined along an intersection of cover plate inner surface 260 and contoured face 264 and extends from side face 262 along a first portion of damper pin slot 254.

As contoured face 264 slopes radially outward, first edge 266 merges into a blended surface 270 that extends along a second portion of damper pin slot 254 between first edge 266 and platform 222. Blended surface 270 extends axially between a first, or downstream, blend edge 272 and a second, or upstream, blend edge 274. More specifically, first blend edge 272 is defined along an intersection of contoured face 264 and blended surface 270 and extends along the second portion of damper pin slot 254, and second blend edge 274 is defined along an intersection of blended surface 270 and cover plate inner surface 260 and extends along the second portion of damper pin slot 254.

In the exemplary embodiment, blended surface 270 has a concave shape. For example, the concave shape of blended surface 270 has a radius of curvature in a range of from about 0.030 inches to about 0.060 inches between first blend edge 272 and second blend edge 274. Alternatively, the concave shape of blended surface 270 has any suitable radius of curvature. In alternative embodiments, blended surface 270 has an suitable shape that enables damper groove 24 to function as described herein.

In some embodiments, damper pin slot 254 is initially formed without blended surface 270, such that contoured face 264 extends from outer surface 258 to inner surface 260. More specifically, contoured face 264 intersects with cover plate inner surface 260 along a second edge 280 (shown in dashed lines) that extends as a continuation of first edge 266 along the second portion of damper pin slot 254. The second portion of damper pin slot 254 is then modified along second edge 280 such that blended surface 270 is formed between contoured face 264 and cover plate inner surface 260. For example, but not by way of limitation, second edge 280 is modified using a suitable machining process. In certain embodiments, additional machining is performed, for example, to further smooth at least one of first blend edge 272 and second blend edge 274. In alternative embodiments, blended surface 270 is formed in any suitable fashion, such as in an initial casting of downstream cover plate 230, that enables damper pin groove 254 to function as described herein.

In certain embodiments, transient interactions between a damper pin (not shown) and damper pin slot 254 including blended surface 270 are reduced, as compared to transient interactions between the damper pin and damper pin slot 254 including second edge 280, thereby reducing a wear on damper pin slot 254 and increasing an operational life cycle of damper pin slot 254. Moreover, although blended surface 270 decreases a thickness of downstream cover plate 230 along the second portion of damper pin slot 254, as compared to second edge 280, it has been determined that, in some embodiments, blended surface 270 results in a peak stress in damper pin slot 254 during operation of rotor assembly 118 that is approximately equal to, or even less than, a peak stress in damper pin slot 254 including second edge 280. Thus, blended surface 270 unexpectedly maintains or improves a structural capability of damper pin slot 254 to transfer pull loads from airfoil 218 to shank 224.

Blended surface 270 has a blend width 282 defined between first blend edge 272 and second blend edge 274, and downstream cover plate 230 has a thickness 284 defined between outer surface 258 and inner surface 260 adjacent to platform 222. In some embodiments, the advantages discussed above are obtained for a blend width 282 in a range of from about 40 percent to about 60 percent of cover plate thickness 284 adjacent to platform 222. For example, cover plate thickness 284 adjacent to platform 222 is about 0.250 inches, and blend width 282 is in a range of from about 0.100 inches to about 0.150 inches. In a particular embodiment, blend width 282 that is about 50 percent of cover plate thickness 284 adjacent to platform 222 results in a decreased peak stress in shank 224 proximate to damper pin slot 254, as compared to damper pin slot 254 including second edge 280. For example, downstream cover plate thickness 284 adjacent to platform 222 is about 0.250 inches, and blend width 282 is about 0.120 inches.

It should be understood that, although blended surface 270 has been described as implemented on downstream portion 255 of damper pin slot 254 defined on downstream cover plate 230, it is envisioned by the present disclosure that, in some embodiments, blended surface 270 is additionally or alternatively implemented in substantially identical fashion on upstream portion 256 of damper pin slot 254.

Figure 6:
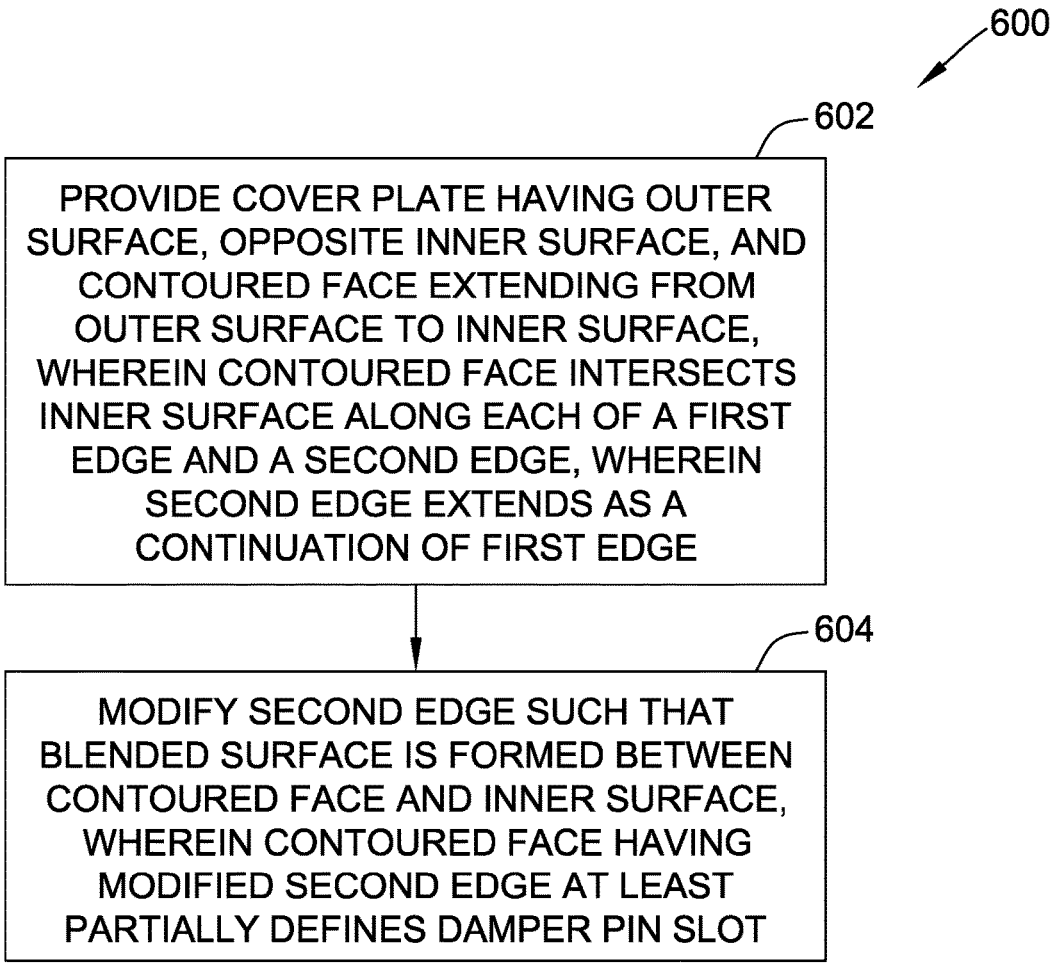
FIG. 6 is a flow diagram illustrating an exemplary method of forming a damper pin slot for a turbine blade, such as the exemplary turbine blade shown in FIG. 3.

FIG. 6 is a flow diagram of an exemplary method 600 of forming a damper pin slot, such as damper pin slot 254, for a turbine blade, such as turbine blade 204. The turbine blade includes a shank, such as shank 224, that includes a cover plate, such as at least one of downstream cover plate 230 and upstream cover plate 228. In the exemplary embodiment, method 600 includes providing 602 the cover plate having outer surface 258, opposite inner surface 260, and contoured face 264 extending from the outer surface to the inner surface. The contoured face intersects the inner surface along each of first edge 266 and second edge 280. The second edge extends as a continuation of the first edge. Method 600 also includes modifying 604 the second edge 280 such that blended surface 270 is formed between the contoured face and the inner surface. The contoured face having the modified second edge at least partially defines the damper pin slot.

The above-described embodiments of turbine blade damper pin slot features and methods of fabricating damper pin slots overcome at least some disadvantages of known turbine blades. Specifically, the damper pin slot includes a blended surface that facilitates reducing wear arising from transient interference with a damper pin, while maintaining stress concentrations in the shank below a threshold level. For example, although the blended surface decreases a thickness of a cover plate along a portion of the damper pin slot, as compared to a comparable damper pin slot without the blended surface, the blended surface nevertheless results in stress concentrations during operation that are approximately equal to, or even less than, a stress concentrations in the comparable damper pin slot without the blended surface. Thus, the blended surface unexpectedly maintains or improves a structural capability of the damper pin slot to transfer pull loads from the airfoil to the shank of the blade. Also specifically, in some embodiments, the damper pin slot is initially formed with a simple edge, and then modified, such as by machining, to form the blended surface, thereby reducing a cost of manufacture of the turbine blade.

Exemplary embodiments of a turbine blade and methods for fabricating the same are described above in detail. The methods and apparatus are not limited to the specific embodiments described herein, but rather, components of systems and/or steps of the method may be utilized independently and separately from other components and/or steps described herein. For example, the methods and apparatus may also be used in combination with other rotary machines and methods, and are not limited to practice with only the gas turbine engine assembly as described herein. Rather, the exemplary embodiment can be implemented and utilized in connection with many other turbine blade applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of forming a damper pin slot for a turbine blade, the turbine blade including a platform and a shank that extends radially inward from the platform, wherein the shank includes a cover plate, said method comprising:

providing the cover plate having an outer surface, an opposite inner surface, a thickness defined between the outer surface and the inner surface adjacent to the platform, and a contoured face extending from the outer surface to the inner surface, the contoured face intersecting the inner surface along each of a first edge and a second edge, wherein the second edge extends as a continuation of the first edge; and modifying the second edge such that a blended surface is formed between the contoured face and the inner surface, the blended surface having a blend width in a range of from 40 percent to 60 percent of the cover plate thickness, wherein the contoured face having the modified second edge at least partially defines the damper pin slot.

2. The method according to claim 1, wherein said modifying the second edge comprises machining the second edge.

3. The method according to claim 1, wherein said modifying the second edge comprises:

forming a first blend edge between the contoured face and the blended surface; and forming a second blend edge between the blended surface and the inner surface.

4. The method according to claim 3, further comprising smoothing at least one of the first blend edge and the second blend edge.

5. The method according to claim 1, wherein said modifying the second edge comprises forming the blended surface having a concave shape.

6. The method according to claim 5, wherein said forming the blended surface having the concave shape comprises forming the blended surface having a radius of curvature in a range of from 0.030 inches to 0.060 inches.

7. The method according to claim 1, wherein said modifying the second edge comprises modifying the second edge such that the first edge merges into the blended surface.

8. The method according to claim 1, wherein said providing the cover plate comprises providing a downstream cover plate.

9. The method according to claim 1, wherein said providing the cover plate comprises providing an upstream cover plate.

10. A method of forming a damper pin slot for a turbine blade, the turbine blade including a platform and a shank that extends radially inward from the platform, wherein the shank includes a cover plate, said method comprising:

providing the cover plate having an outer surface, an opposite inner surface, a thickness defined between the outer surface and the inner surface adjacent to the platform, and a contoured face extending from the outer surface to the inner surface, the contoured face intersecting the inner surface along each of a first edge and a second edge, wherein the second edge extends as a continuation of the first edge; and modifying the second edge such that a blended surface is formed between the contoured face and the inner surface, the blended surface having a blend width of about 50 percent of the cover plate thickness, wherein the contoured face having the modified second edge at least partially defines the damper pin slot.

11. The method according to claim 10, wherein said modifying the second edge comprises machining the second edge.

12. The method according to claim 10, wherein said modifying the second edge comprises:

forming a first blend edge between the contoured face and the blended surface; and forming a second blend edge between the blended surface and the inner surface.

13. The method according to claim 10, further comprising smoothing at least one of the first blend edge and the second blend edge.

14. The method according to claim 10, wherein said modifying the second edge comprises forming the blended surface having a concave shape.

15. The method according to claim 14, wherein said forming the blended surface having the concave shape comprises forming the blended surface having a radius of curvature in a range of from 0.030 inches to 0.060 inches.

16. The method according to claim 10, wherein said modifying the second edge comprises modifying the second edge such that the first edge merges into the blended surface.

17. The method according to claim 10, wherein said providing the cover plate comprises providing a downstream cover plate.

18. The method according to claim 10, wherein said providing the cover plate comprises providing an upstream cover plate.

* * * * *